US012024845B2

(12) United States Patent
Crites

(10) Patent No.: US 12,024,845 B2
(45) Date of Patent: Jul. 2, 2024

(54) METHOD FOR MANHOLE RISER EXTENSIONS

(71) Applicant: Michael Crites, Delphos, OH (US)

(72) Inventor: Michael Crites, Delphos, OH (US)

( * ) Notice: Subject to any disclaimer, the term of this patent is extended or adjusted under 35 U.S.C. 154(b) by 604 days.

(21) Appl. No.: 17/352,692

(22) Filed: Jun. 21, 2021

(65) Prior Publication Data

US 2022/0403615 A1 Dec. 22, 2022

(51) Int. Cl.
*E02D 29/12* (2006.01)

(52) U.S. Cl.
CPC ..... *E02D 29/128* (2013.01)

(58) Field of Classification Search
CPC ..... E02D 29/128
USPC ..... 404/25, 26, 75
See application file for complete search history.

(56) References Cited

U.S. PATENT DOCUMENTS 1,030,384 A * 6/1912 Clarkson ..... B28B 7/06 425/DIG. 126
4,466,219 A 8/1984 Campolito
4,737,220 A * 4/1988 Ditcher ..... E02D 29/14 156/218
5,318,376 A * 6/1994 Prescott, Sr. ..... E02D 29/1409 404/26
5,470,131 A * 11/1995 Nolan ..... E01C 23/094 404/72
6,514,008 B1 * 2/2003 Smolnik ..... E02D 29/16 405/26
6,536,987 B2 * 3/2003 Chang ..... E01C 23/0933 175/57
6,851,225 B1 * 2/2005 Haar ..... E02D 29/1409 404/26
6,869,249 B2 * 3/2005 Calhoon ..... E02D 29/1445 404/26
7,165,911 B2 1/2007 Fier
7,494,191 B1 * 2/2009 Crites ..... E02D 29/1445 30/105
9,121,157 B2 9/2015 Wasiuta et al.
11,015,307 B1 * 5/2021 Crites ..... E02F 5/16
2016/0108601 A1 * 4/2016 Strand ..... E01C 11/005 404/75

* cited by examiner

*Primary Examiner* — Raymond W Addie
(74) *Attorney, Agent, or Firm* — Harpman & Harpman

(57) ABSTRACT

A manhole riser system including upper and lower flanged rings with an adjustable height sleeve for raising the height of the manhole support cover frame to a new pavement level. The adjustable height sleeve is cut and overlapped for various dimensions and a pavement grade marking assembly provides for custom height cutting during placement assembly within the manhole.

9 Claims, 8 Drawing Sheets

METHOD FOR MANHOLE RISER EXTENSIONS

BACKGROUND OF THE INVENTION

1. Technical Field

This invention relates to manhole removal and replacement to raise the manhole cover frame to a new permanent level.

2. Description of Prior Art

Such prior art manhole riser extension assemblies rely on multiple rings to selectively raise the effective height of the manhole cover support frame, see for example U.S. Pat. Nos. 4,466,219, 7,165,911, and 9,121,157, all of which are directed to a variety of clip ring assemblies with projecting engagement tabs in interlinking rings by fasteners and welding such as seen in U.S. Pat. No. 4,466,219.

SUMMARY OF THE INVENTION

A method to refurbish manholes that utilize multiple steps for effectively raising the manhole. The system uses a size controllable riser sleeve custom cut to provide for a finish street level pavement edge height. A pair of interengaging oppositely disposed support and mounting flange riser rings provide oppositely disposed installation engagement surfaces on an annular sleeve. A contoured following marking tool provides for a guide cutting line on the riser height during assembly.

DETAILED DESCRIPTION OF THE INVENTION

Figure 10:
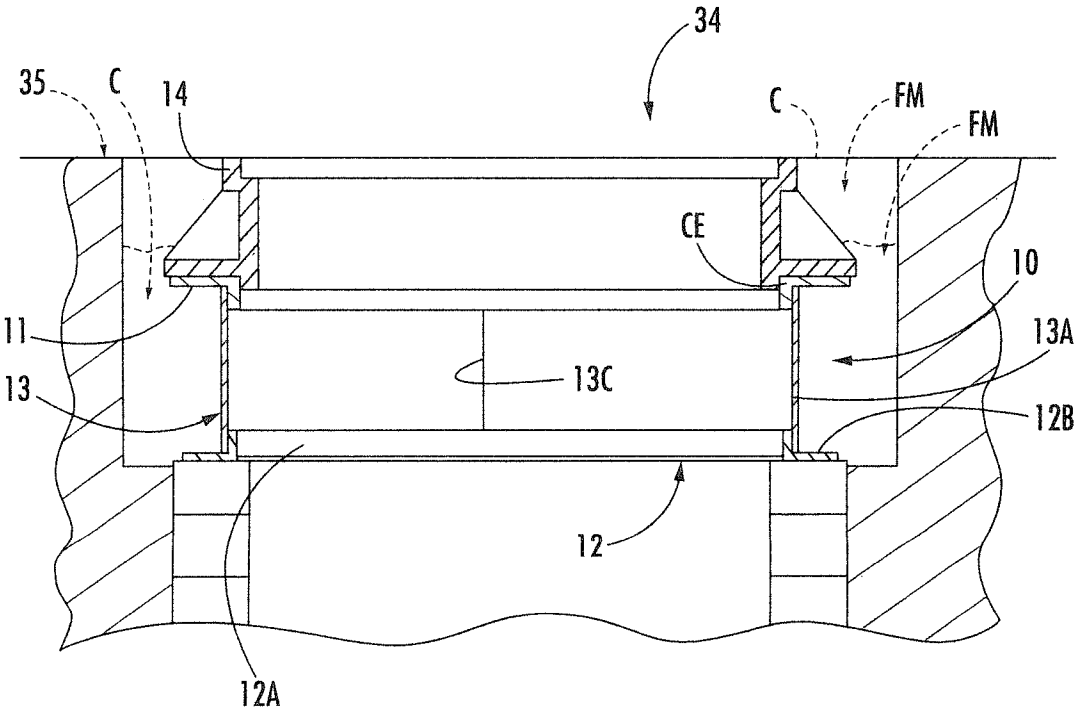
FIG. 10 is a sectional view of a repaired manhole with a completed riser insert assembly and manhole cover support frame.

A manhole riser system of the invention can be seen in FIGS. 1-4 of the drawings having a riser insert assembly 10 with a pair of annular riser flange rings 11 and 12 and a configurable riser band 13A. The respective riser flange rings 11 and 12 are identical and will provide respective flange mounting surfaces for engagement support on the riser band 13A and correspondingly the manhole cover support fitting 14 when positioned thereon as seen in FIG. 10 of the drawings.

A riser sleeve 13 is adjustably formed from flexible synthetic riser band 13A. The riser band 13A is formed into varied dimensional riser sleeve 13 by securing the respective free ends together 13B and 13C, in this example, by overlapping end surface engagement. An adhesive seal S and selective mechanical fasteners F may be used to secure same.

By utilization of flexible riser bands 13A, a significant advantage is achieved in both transportation and the ability to easily match variants in required diameter that may be needed.

The respective riser flange rings 11 and 12 have a central upstanding annular portions 11A and 12A and respective wide annular flanges 11B and 12B extending therefrom. The riser flange rings 11 and 12 so formed are adhesively secured to the formed riser sleeve 13 sequentially in oppositely disposed flange engagement orientation, best seen in FIGS. 1, 2 and 10 of the drawings.

Figure 6:
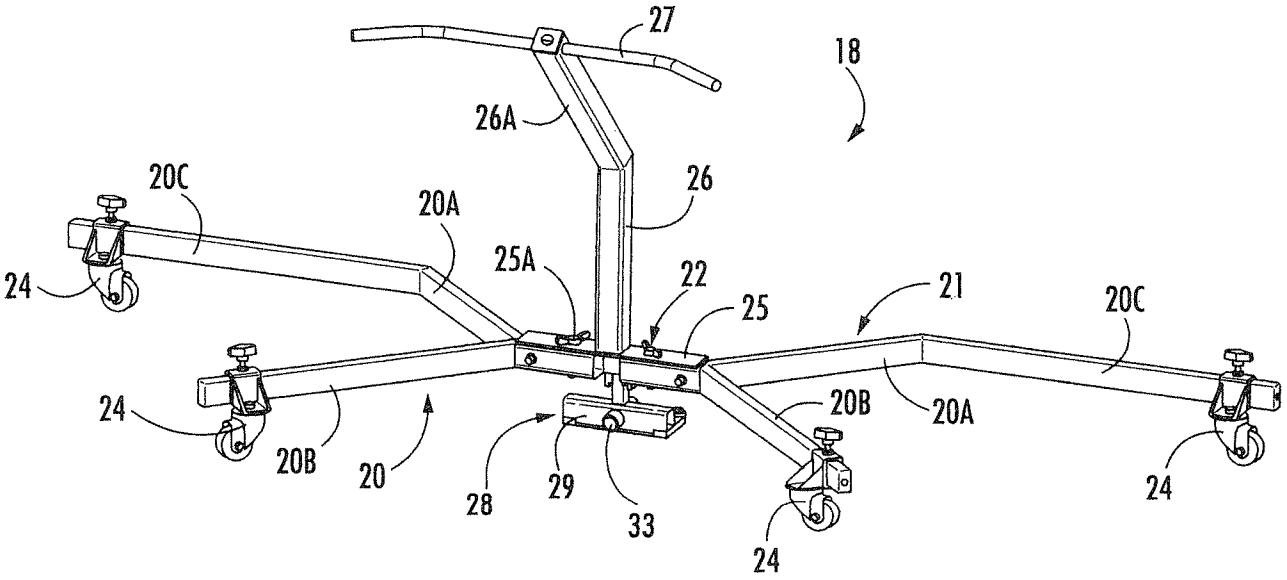
FIG. 6 is a perspective view of a surface alignment marking tool.
Figure 7:
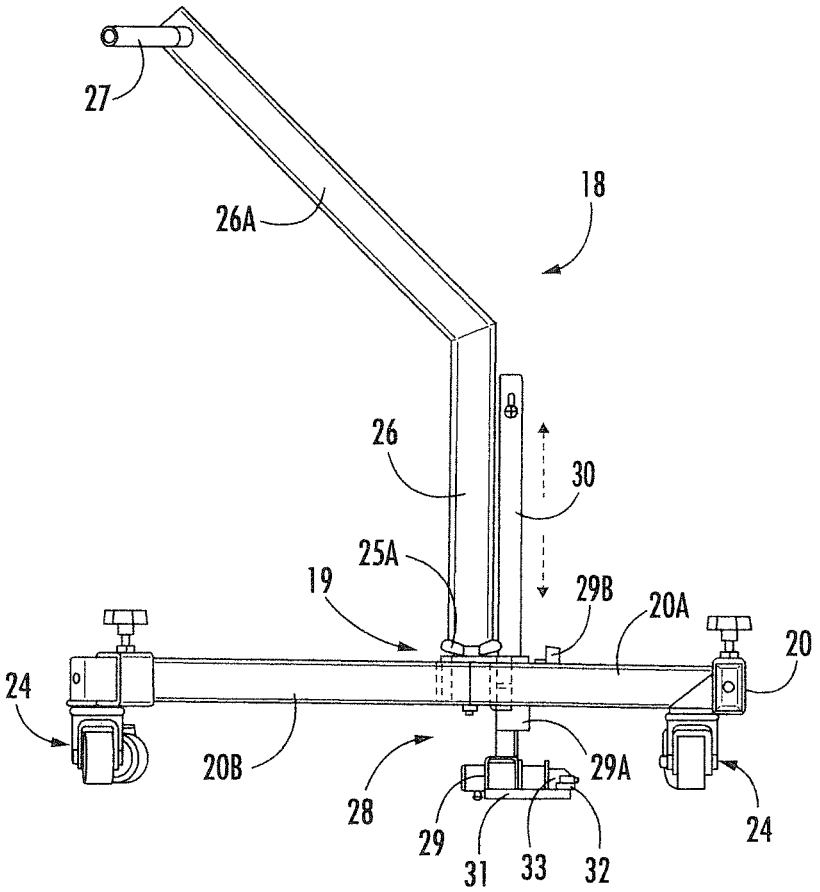
FIG. 7 is an enlarged end elevational view thereof.
Figure 8:
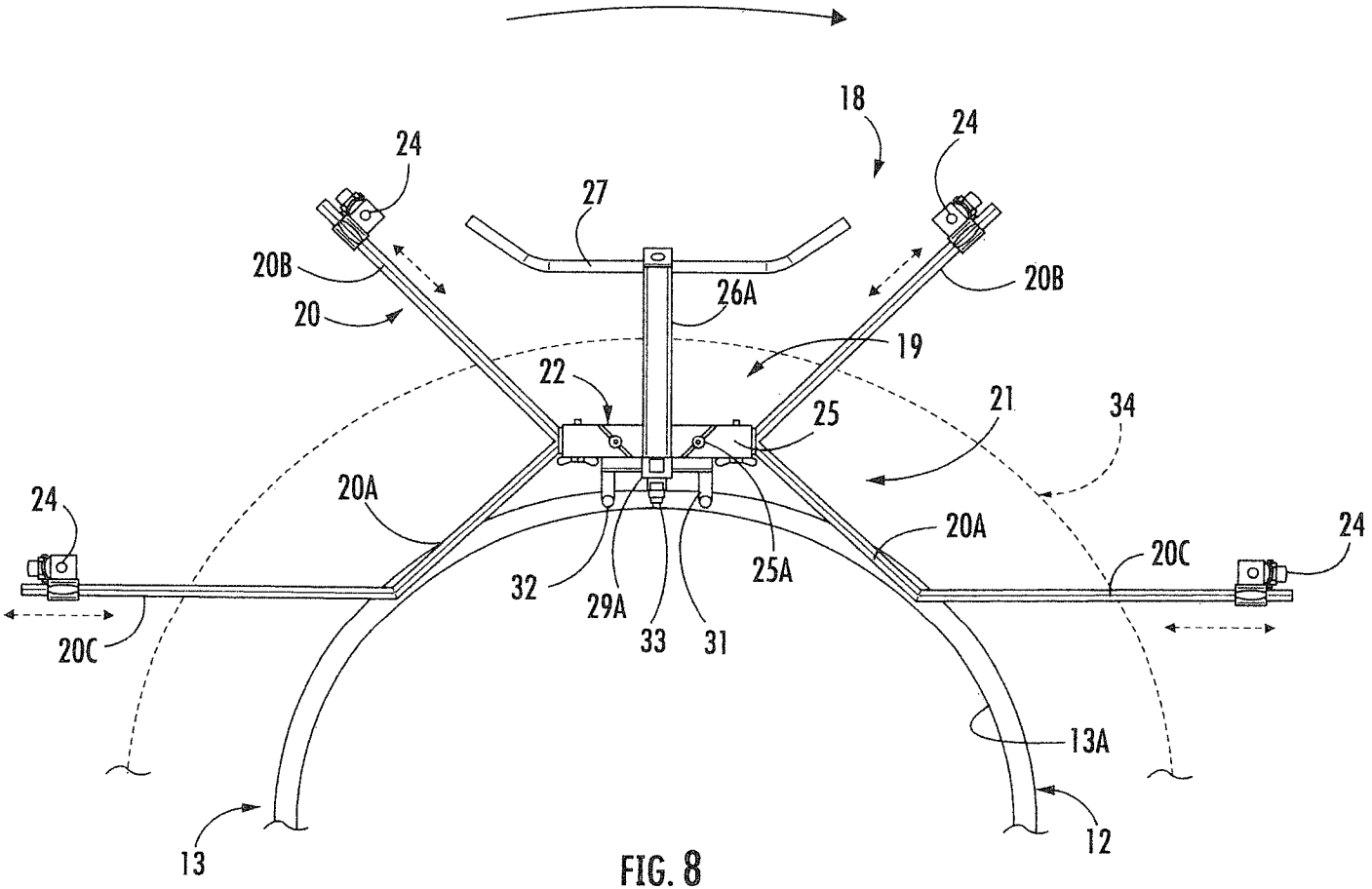
FIG. 8 is a top plan view of the surface alignment marking tool engaged graphically on a riser insert assembly during assembly thereof.

To effectively configure the riser sleeve 13 to the grade which will vary in required depth and angular inclination dependent on the pavement grade and engagement within the existing manhole surface chimney MC onto which the riser system is placed each riser sleeve 13 needs to be custom cut for the appropriate height. Accordingly, a surface alignment marking tool 18 is provided, best seen in FIGS. 6-9 of the drawings having a wheeled support carriage 19 with a pair of bifurcated armatures 20 and 21 extending from a central junction mounting bracket 22. Each of the respective armatures 20 and 21 have a pair of tubular angularly offset arms 20A and 20B extending from the central junction mounting bracket 22. The arms 20A each have a secondary angular offset portion 20C, best seen in FIGS. 6 and 8 of the drawings. Each of the respective arm pairs 20A and 20B have adjustable wheel assemblies 24 adjacently positioned on their free ends which are therefore in translateral spaced orientation to one another and their oppositely disposed arm end pairs. The central junction mounting bracket 22 has, in this example, an apertured angle iron fitting 25 with pairs of adjustable engagement wing nuts and bolt fasteners 25A for frictionally securing the respective armatures 20 and 21 therein. An upstanding handle post 26 extends at a right angles through the angle iron fitting 25 with an angular offset handle receiving portion 26A extending therefrom through which a transverse handle bar 27 extends, best seen in FIG. 8 of the drawings.

A sleeve marker assembly 28, best seen in FIGS. 6, 7, 8 and 9 of the drawings, is adjustably secured to the angle iron fitting 25 through a sleeve 29A vertically secured thereon in parallel alignment with the handle post 26. The marker holder 28 has a main tubular body member 29 with an upstanding height adjustment post 30 extending centrally therefrom and slidably disposed within the sleeve 29A as hereinbefore described. A threaded adjustment fitting and knob 29B is provided for selective repositioning and securing the height adjustable post 30 as required.

A pair of oppositely disposed end aperture guide mounting arms 31 extend at right angles from the respective free ends of the main tubular mounting body member 29, each with guide rollers 32 mounted thereon. A replaceable line marker 33 is removably secured through a marker holder which extends through the main body member 29 in alignment with the adjustment post 30 and between the respective guide roller arms 31 to maintain proper orientation during use as will be described hereinafter.

Referring to FIGS. 1-3 and 8-10 of the drawings, in operation the manhole riser extension apparatus and installation method can be seen wherein a manhole opening 34 in a pavement surface 35 has been prepared by applicant's manhole cutter and removing device described and disclosed in applicant's U.S. Pat. No. 8,011,851 which is hereby incorporated by reference in its entirety herewith. The manhole opening 34 is thus prepared for installation and raising exposes the chimney MC mounting surfaces 36 therein.

The form riser band 13A, as hereinbefore described, is fitted with the first annular riser flange ring 12 by adhesives applied thereto with the bottom edge of the riser band 13A engaged on the flange ring 12 and adhesively sealed therewith. The so defined partially assembled sleeve 13 is initially placed on the surface 36 of the chimney structure MC.

Figure 9:
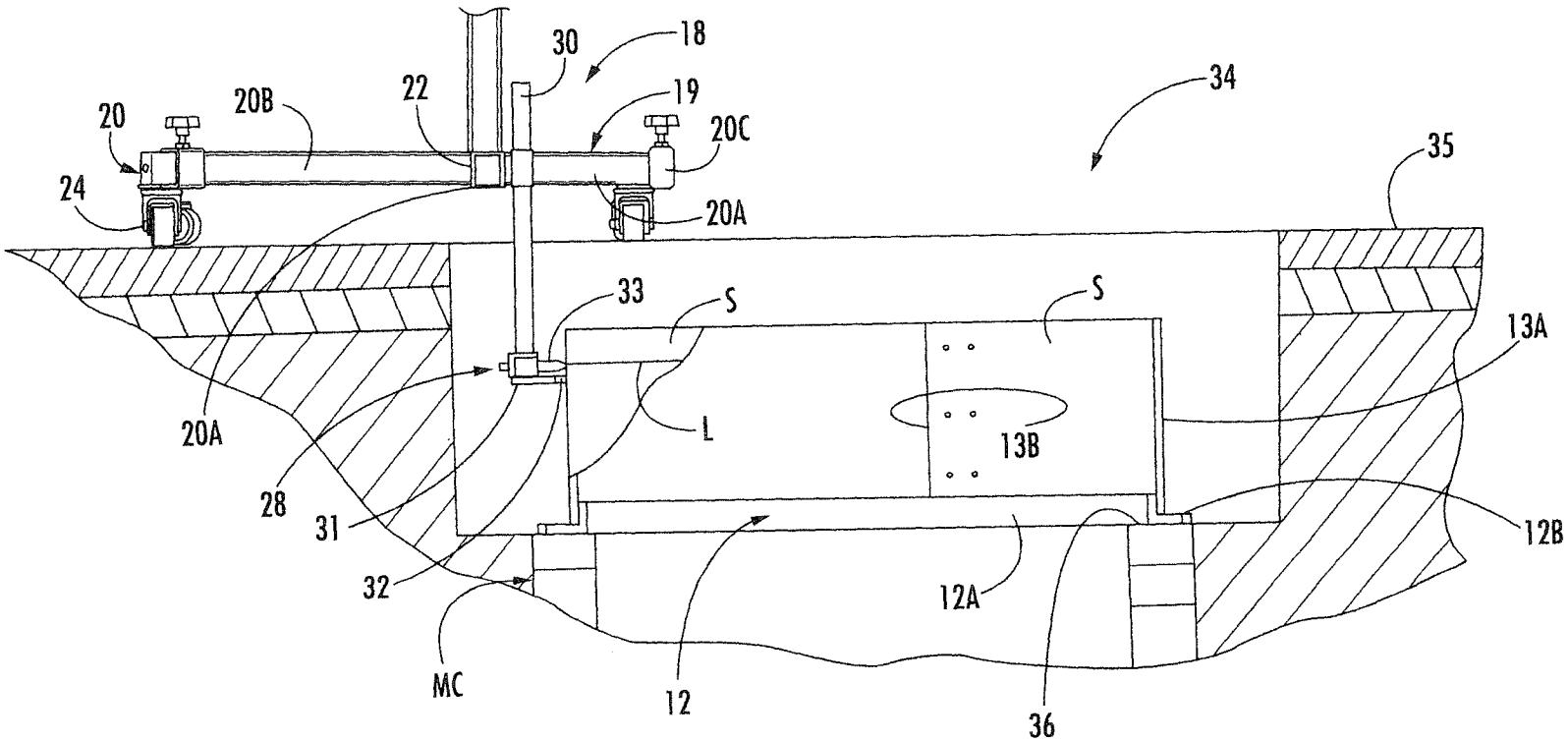
FIG. 9 is a partial sectional view of a manhole during repair with a riser insert assembly and marking tool engaged thereon.

To mark and cut the riser sleeve 13 to proper height, the surface alignment marking tool 18 is, as assembled, placed on the side of the manhole opening 34 and the marker holding assembly 28 is vertically adjusted to the predetermined positional height to accommodate the varied positioning depth for riser sleeve 13 placement and the marker holder engagement. The line marker 33 is engaged on the outer surface S of the riser band 13A and the surface alignment marking tool 18 is thereby moved manually via the handle rod 27 on its multiple wheel assembly 19 about the manhole opening 34 imparting a guideline L for cutting on the riser band 13A surface as seen in FIG. 9 of the drawings. The riser sleeve 13 is then removed and cut along the guide line L by conventional cutters appropriate to the sleeve material and thickness which, in this instance, is of a synthetic resin material having a thickness to provide flexibility to achieve the annular riser sleeve shape when so assembled.

Figure 1:
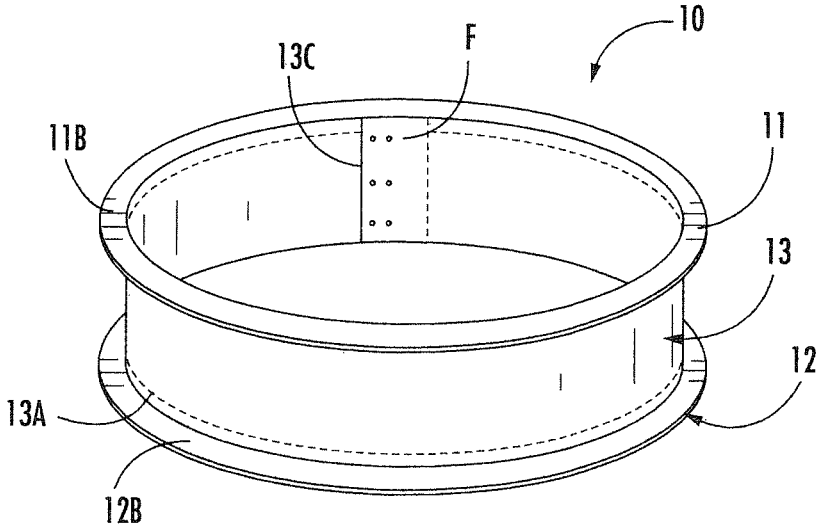
FIG. 1 is a perspective view of the riser insert assembly ring.
Figure 2:
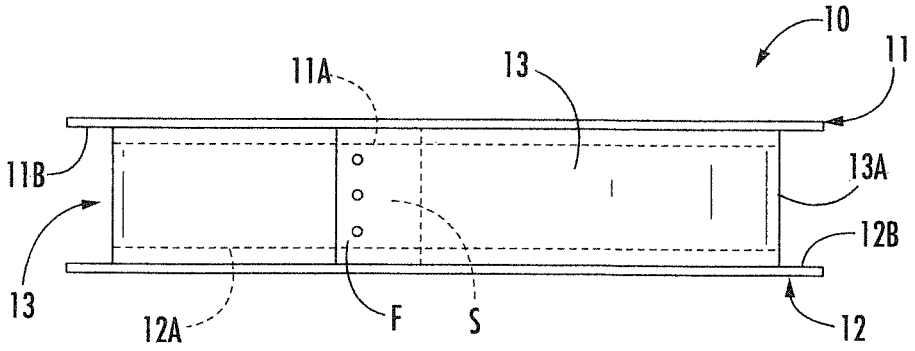
FIG. 2 is a side elevational view thereof.
Figure 3:
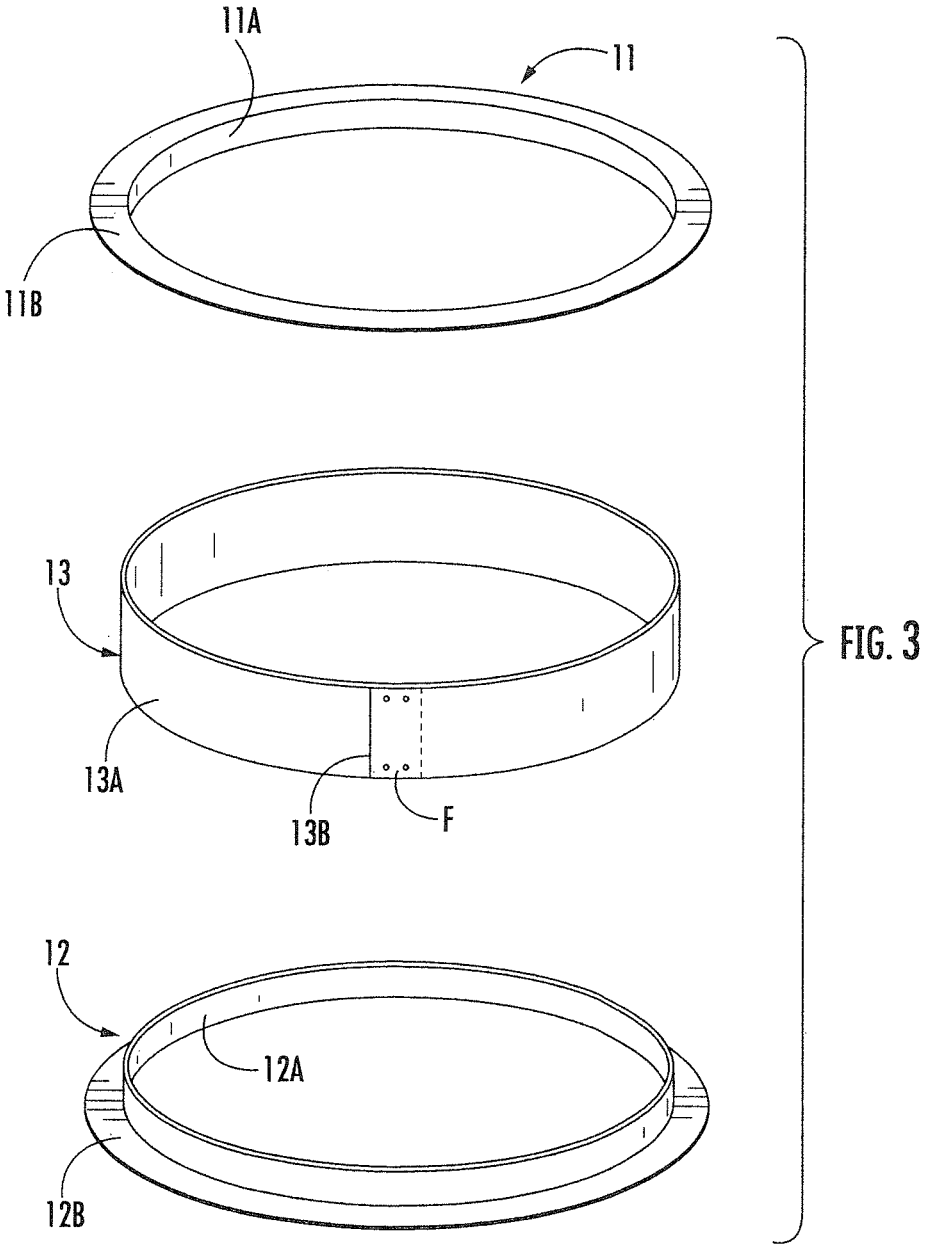
FIG. 3 is an exploded assembly perspective view of the riser sleeve insert assembly ring.
Figure 4:
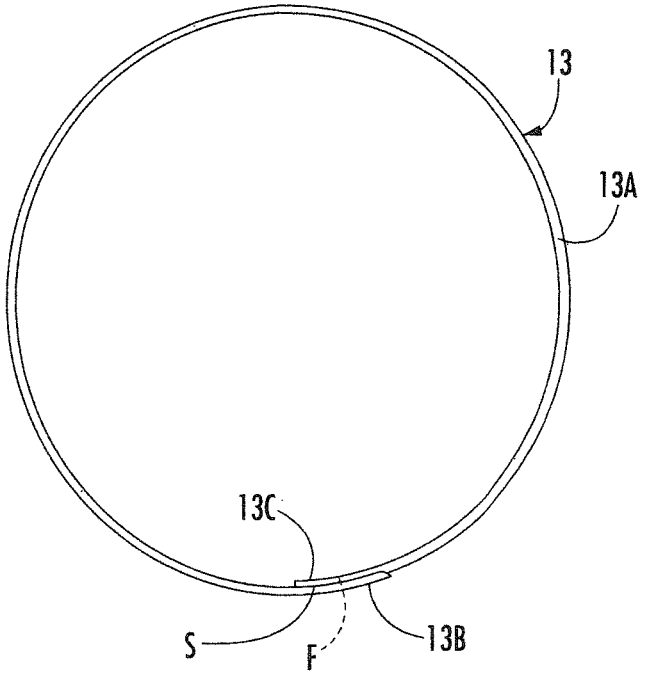
FIG. 4 is a top plan view of a riser sleeve of the assembly.
Figure 5:
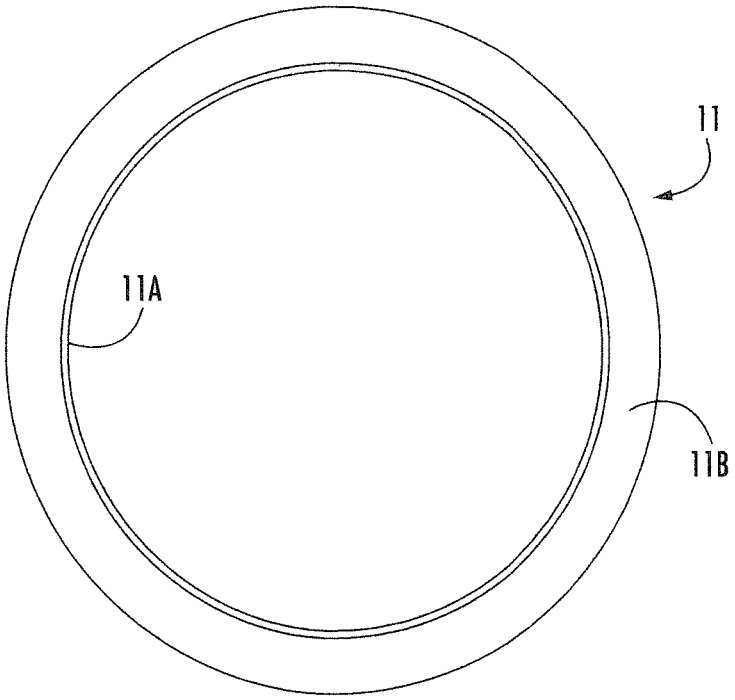
FIG. 5 is a top plan view of a riser flange ring of the assembly.

The remaining riser flange ring 11 is then adhesively secured to the upper cut sleeve edge CE completing the riser sleeve 13 assembly illustrated in FIGS. 1, 2 and 10 of the drawings.

The manhole cover fitting 14 is then preferably adhesively secured to the bottom riser ring flange 11B which provides a wide contact surface engagement.

Once completed, filled material FM indicated by broken arrow lines is infilled about the installed riser 13 and its attached manhole frame 14 with final infill there about to street level with premix concrete indicated in broken lines at C providing a completed flush manhole replacement repair sequence.

It will thus be seen that a new and novel method and application for repair and replacement of manholes has been illustrated and described and it will be apparent to those skilled in the art that various changes and modifications may be made therein without departing from the spirit of the invention.

Therefore I claim:

1. A method for removing and raising manhole fittings comprising, cutting and removing a disk-shaped portion of the paved roadway with a manhole fitting within, placing a partially configured riser sleeve within an opening defined by the paved roadway, positioning a surface alignment marking tool and marking said riser sleeve about its exterior annular surface, cutting the riser sleeve along its annular surface marking, securing a riser flange ring on the cut edge surface of the riser sleeve, securing a riser and ring flange assembly within the opening defined by the paved roadway, securing a manhole cover support frame onto the riser flange ring, back filling the opening about the completed riser sleeve and manhole cover support frame.

2. The method of removing and raising a manhole fitting set forth in claim 1 wherein removing a disk-shaped portion of the paved roadway with a manhole within comprises, a pavement cutter and manhole assembly remover.

3. The method of removing and raising a manhole fitting set forth in claim 1 wherein said partially configured riser sleeve comprises, a riser band of flat flexible material joined together at its oppositely disposed end and a first riser flange ring secured to said formed annular band.

4. The method of removing and raising manhole fittings set forth in claim 1 wherein said surface alignment marking tool comprises, a pair of bifurcated armatures, each having a wheel assembly defining a support carriage with an upstanding handle, a marker holder depending from said support carriage and a marker positioned within said holder.

5. The method of removing and raising a manhole fitting set forth in claim 4 wherein said marker holder comprises, apertured main body member, a line marker removably secured there within, a height adjustable post extending from said body member, and a pair of guide wheels extending from said body member.

6. The method of removing and raising a manhole fitting set forth in claim 1 wherein securing said riser flange ring on the cut edge surface of the riser sleeve comprises, a bead of adhesive on the junction of said riser flange ring and said riser sleeve.

7. The method of removing and raising a manhole fitting set forth in claim 3 wherein securing a riser flange ring on the riser sleeve comprises, a bead of adhesive on the junction of said inner ring flange.

8. The method of removing and raising a manhole fitting set forth in claim 1 wherein securing a riser ring assembly within the opening defined by the paved roadway comprises, applying a bead of adhesive on the riser ring flange.

9. The method of removing and raising a manhole fitting set forth in claim 1 wherein said securing a manhole cover support frame onto a riser flange ring comprises, a bead of adhesive on the riser flange ring flange and positioning said manhole cover support frame thereon.

* * * * *